US011022362B2

(12) United States Patent
Yazawa et al.

(10) Patent No.: US 11,022,362 B2
(45) Date of Patent: Jun. 1, 2021

(54) DAMPER DEVICE

(71) Applicant: NIDEC SANKYO CORPORATION, Suwa-gun Nagano (JP)

(72) Inventors: Takehiko Yazawa, Suwa-gun Nagano (JP); Satoru Yokoe, Suwa-gun Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 457 days.

(21) Appl. No.: 15/847,070

(22) Filed: Dec. 19, 2017

(65) Prior Publication Data

US 2018/0340725 A1 Nov. 29, 2018

(30) Foreign Application Priority Data

May 26, 2017 (JP) ..... JP2017-104122

(51) Int. Cl.
*F25D 17/04* (2006.01)
*F25D 21/14* (2006.01)

(52) U.S. Cl.
CPC ..... *F25D 17/045* (2013.01); *F25D 21/14* (2013.01)

(58) Field of Classification Search
CPC .. F25D 17/062; F25D 21/065; F25D 2317/06; F25D 2321/14; F24F 13/10; F24F 13/105; F24F 13/12; F24F 13/14; F16K 1/2071; F16K 1/2266; F16K 15/025; F16K 15/033
USPC ..... 454/333, 334
See application file for complete search history.

(56) References Cited

U.S. PATENT DOCUMENTS 5,361,596 A * 11/1994 Martin ..... F25D 17/045 251/303
2004/0000655 A1* 1/2004 Noritake ..... F24F 13/1426 251/129.12
2009/0188273 A1* 7/2009 Dirnberger ..... F16K 1/2007 62/404
2011/0041930 A1* 2/2011 Kiezulas ..... F16K 15/035 137/527

FOREIGN PATENT DOCUMENTS

JP 2015061393 A 3/2015

* cited by examiner

*Primary Examiner* — Steven B McAllister
*Assistant Examiner* — Charles R Brawner
(74) *Attorney, Agent, or Firm* — Cantor Colburn LLP

(57) ABSTRACT

A damper device may include a frame structured of a tube part and an opening part formed on an inner side of the tube part, a baffle which is disposed on the inner side of the tube part and is supported by the frame in a state that the baffle is capable of being turned with a first edge as a turning center, and a baffle drive mechanism structured to turn the baffle between a closing position where the opening part is closed and an open position where the opening part is opened. The baffle is formed with a cut-out part at least one position of an edge except the first edge.

17 Claims, 5 Drawing Sheets

DAMPER DEVICE

CROSS REFERENCE TO RELATED APPLICATION

The present application claims priority under 35 U.S.C. § 119 to Japanese Application No. 2017-104122 filed May 26, 2017, the entire content of which is incorporated herein by reference.

FIELD OF THE INVENTION

At least an embodiment of the present invention may relate to a damper device structured to drive an opening and closing member such as a baffle so that an opening part is opened and closed.

BACKGROUND

As a damper device for controlling flow of cold air in a refrigerator, for example, a device has been known in which a baffle is driven by a baffle drive mechanism to open and close an opening part which is formed in a frame. This type of damper device is disclosed in Japanese Patent Laid-Open No. 2015-61393. In the damper device described in Patent Literature 1, a frame is provided with a tube-shaped body which surrounds an opening part, and the entire periphery of a baffle for opening and closing the opening part is surrounded by the tube-shaped body. The baffle includes an opening and closing plate in a rectangular shape and a sheet member (elastic member) having elasticity which is attached to a face on an opening part side of the opening and closing plate.

In the damper device described in the above-mentioned Patent Literature, a space between the baffle and a frame (tube-shaped body) is narrow and thus, in a case that dew condensation water is adhered to the opening and closing plate, the dew condensation water is flowed to the space between the tube-shaped body and the opening and closing plate, and the dew condensation water may freeze in a state that the dew condensation water stays between the opening and closing plate and the tube-shaped body. When the situation is occurred, an operation of the baffle is disturbed by the frozen water and thus a normal operation of the baffle may not be performed.

As a measure for a defective operation of the baffle due to freezing of the dew condensation water, it is conceivable that a space between the baffle and the frame is widened to prevent dew condensation water from staying between the baffle and the frame. However, in order to widen the space without increasing the size of an outward shape of the frame, the sizes of the baffle and the opening part are required to be reduced. Therefore, a sufficient flow amount may not be secured.

In order to secure a flow amount while widening a space between the baffle and the frame, it is conceivable that wall thickness of the frame is reduced or a structure of the baffle is modified. For example, the baffle is formed with a rib for positioning a sheet member having elasticity at an edge of an opening and closing plate and the rib is projected to an outer peripheral side with respect to an opening part. Therefore, if the rib is not provided, the size of the baffle can be reduced without changing the size of the opening part. However, in a case that a rib is not provided, positioning of the sheet member to the opening and closing plate is difficult and thus assembling workability is deteriorated. Further, in a case that wall thickness of the frame is reduced, strength of the frame is decreased and thus the frame may be deformed by an urging force of the urging member which is applied to its supporting portion for urging the baffle.

SUMMARY

In view of the problem described above, at least an embodiment of the present invention may advantageously provide a damper device which is capable of suppressing a defective operation of a baffle due to freezing of dew condensation water without affecting an opening area of the opening part, strength of a frame, assemblability of the baffle and the like.

According to at least an embodiment of the present invention, there may be provided a damper device including a frame provided with a tube part and an opening part formed on an inner side of the tube part, a baffle which is disposed on the inner side of the tube part and is supported by the frame in a state that the baffle is capable of being turned with a first edge as a turning center, and a baffle drive mechanism structured to turn the baffle between a closing position where the opening part is closed and an open position where the opening part is opened. The baffle is formed with a cut-out part at least one position of an edge except the first edge.

In at least an embodiment of the present invention, as described above, a cut-out part is formed at least one position of an edge except an edge on a side of the turning center axial line of the baffle. Therefore, a space between the baffle and an inner face of the tube part is large in a portion where the cut-out part is formed and thus freezing of dew condensation water in a state that the dew condensation water stays between the baffle and the tube part (frame) is suppressed. Accordingly, a defective operation of the baffle can be suppressed. Specifically, it may be structured that the tube part is provided with a partition wall, which partitions the inner side of the tube part from a space in which the baffle drive mechanism is disposed, and an opposing wall which faces the partition wall, a side edge is provided at two positions on both sides of the first edge, and spaces between the two side edges and the partition wall and the opposing wall are enlarged by the cut-out parts.

In at least an embodiment of the present invention, the baffle includes an opening and closing plate and an elastic member attached to a face on a side of the opening part of the opening and closing plate, the opening and closing plate is provided with an edge in which the cut-out part is not formed, and the face on the side of the opening part of the opening and closing plate is provided with a positioning rib structured to position the elastic member in at least a part of the edge in which the cut-out part is not formed. Specifically, it may be structured that the positioning rib is provided in at least one of the first edge and a second edge on an opposite side to the first edge of the opening and closing plate. According to this structure, the positioning rib can be provided at a position different from the cut-out part and thus the elastic member is positioned and degradation of assemblability can be suppressed. For example, in a case that the baffle is disposed so that the cut-out part is formed in a portion where dew condensation water is easily collected and, in addition, the positioning rib is arranged in a portion where dew condensation water is hard to be collected, a defective operation of the baffle can be suppressed while suppressing degradation of assemblability.

In at least an embodiment of the present invention, the baffle is structured so that the first edge (edge on the turning center side) is located on a lower side in a vertical direction with respect to a second edge on an opposite side to the first edge of the opening and closing plate. Specifically, the baffle may include an opening and closing plate, which is formed in a rectangular shape, and an elastic member formed in a rectangular shape which is attached to a face of the opening and closing plate on a side of the opening part. The opening and closing plate is provided with the first edge, a second edge on an opposite side to the first edge, and two side edges connecting the first edge with the second edge. The cut-out part is formed in each of the two side edges and, in a state that the frame is attached to a main body device, when the baffle is moved to the closing position and the open position, the first edge is always located on a lower side with respect to the second edge. In a case that the baffle is disposed as described above, dew condensation water adhered to the baffle is collected in an edge on the turning center axial line side of the baffle and a bottom part of the frame. Therefore, dew condensation water is hard to freeze in a state that dew condensation water stays between an edge except an edge on the turning center axial line side and the tube part (frame) and thus a defective operation of the baffle can be suppressed.

In this case, it is desirable that the cut-out part is formed in a side edge intersecting the first edge at a position close to the first edge. For example, it is desirable that, in a case that the baffle includes a shaft part formed in the first edge, the side edge is formed with the cut-out part having a width so as to reach to the shaft part. According to this structure, the cut-out part is formed in a region where dew condensation water is easily collected in an edge (side edge) intersecting the first edge. For example, the cut-out part is formed so as to reach to the shaft part provided at a turning center of the baffle. Specifically, it may be structured that the opening and closing plate is provided with a shaft part which serves as a turning center of the opening and closing plate, the shaft part being formed at a corner part where the first edge and a first side edge of the two side edges are connected, and the first side edge is formed with the cut-out part having a width so as to reach to the shaft part. Therefore, in a region where dew condensation water is easily collected, dew condensation water is hard to freeze in a state that the dew condensation water stays between the baffle and the tube part (frame) and thus a defective operation of the baffle is hard to be occurred.

In at least an embodiment of the present invention, the baffle is provided with a dew condensation water holding rib which is formed on an opposite side face to the opening part, and the dew condensation water holding rib is formed along the first edge. According to this structure, dew condensation water flowing toward an edge on the turning center axial line side of the baffle (in other words, toward an edge on a lower side in the vertical direction) is held by the dew condensation water holding rib and thus dew condensation water flowing from the baffle to the bottom part of the frame is reduced. Therefore, freezing of dew condensation water due to flowing out to the bottom part of the frame is suppressed and thus disturbance to an operation of the baffle can be suppressed.

In this case, it is desirable that the dew condensation water holding rib is connected with a rib formed along the side edge. For example, it is desirable that the dew condensation water holding rib is connected with a dew condensation water holding supplementary rib which is formed along each of the two side edges. According to this structure, a rib is continuously formed at a corner part in which an edge on the turning center axial line side and a side edge of the baffle are connected with each other. Therefore, dew condensation water can be held without flowing out from the baffle and thus freezing of dew condensation water due to flowing out to the bottom part of the frame is suppressed and disturbance to an operation of the baffle can be suppressed.

In at least an embodiment of the present invention, the baffle includes a baffle reinforcing rib which is formed on an opposite side face to the opening part, and a protruded height of the dew condensation water holding rib is higher than a protruded height of the baffle reinforcing rib. According to this structure, a lot of dew condensation water can be held. Therefore, freezing of dew condensation water due to flowing out to the bottom part of the frame is suppressed and thus disturbance to an operation of the baffle can be suppressed.

In at least an embodiment of the present invention, the baffle drive mechanism includes an urging member which is disposed between the frame and the baffle, and the frame is formed with a holding part which holds an end part of the urging member and a frame reinforcing rib which is connected with the holding part. According to this structure, deformation of the frame by an urging force of the urging member can be suppressed.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

A damper device will be described below with reference to the accompanying drawings as an embodiment of a damper device to which the present invention is applied, the damper device being attached to an inside of a refrigerator which is a main body device for adjusting a supply amount of cold air. A damper device in accordance with at least an embodiment of the present invention is not limited to this application and may be used in various devices (main body device) in which an intake port for a fluid is opened and closed to adjust its flow amount.

(Entire Structure)

Figure 1:
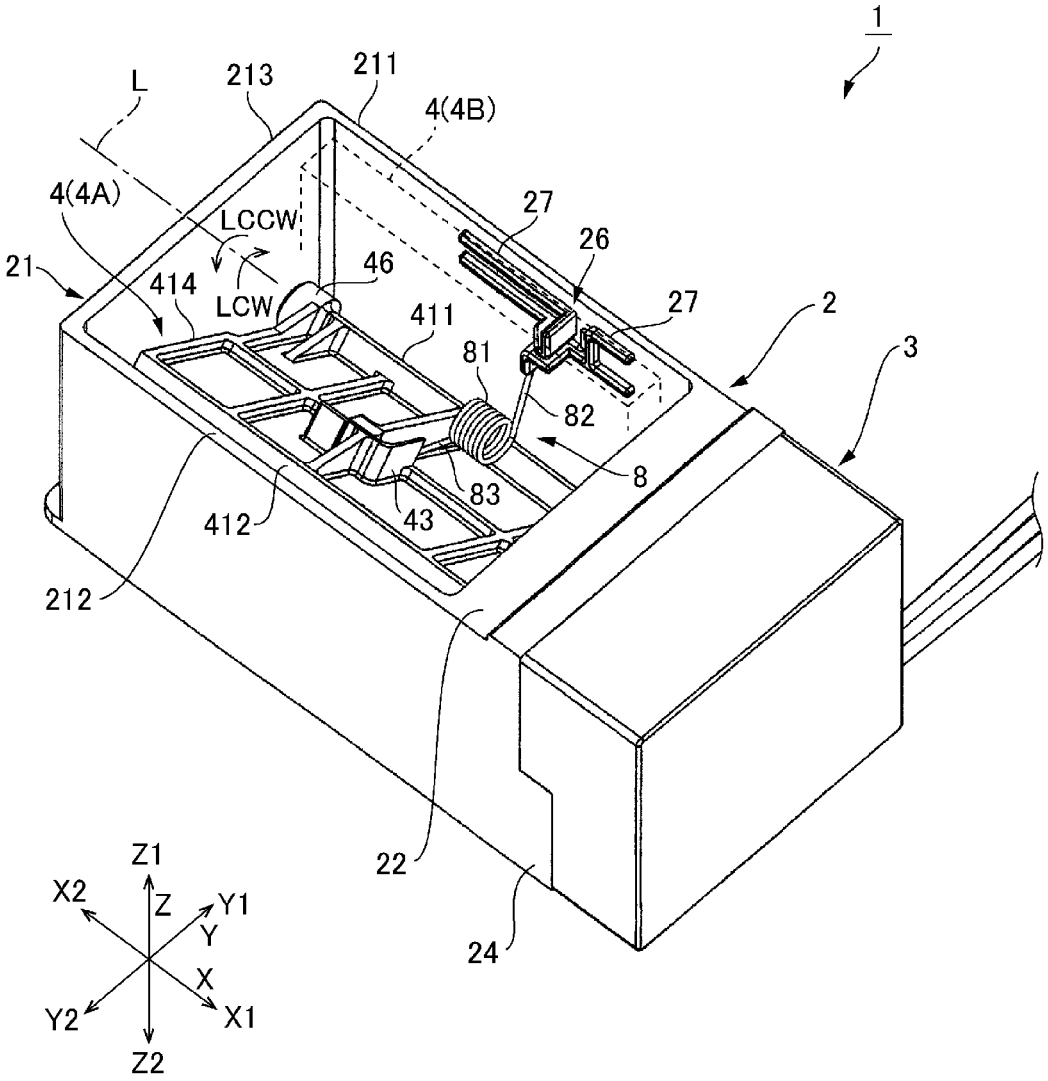
FIG. 1 is a perspective view showing a damper device in accordance with at least an embodiment of the present invention.
Figure 2:
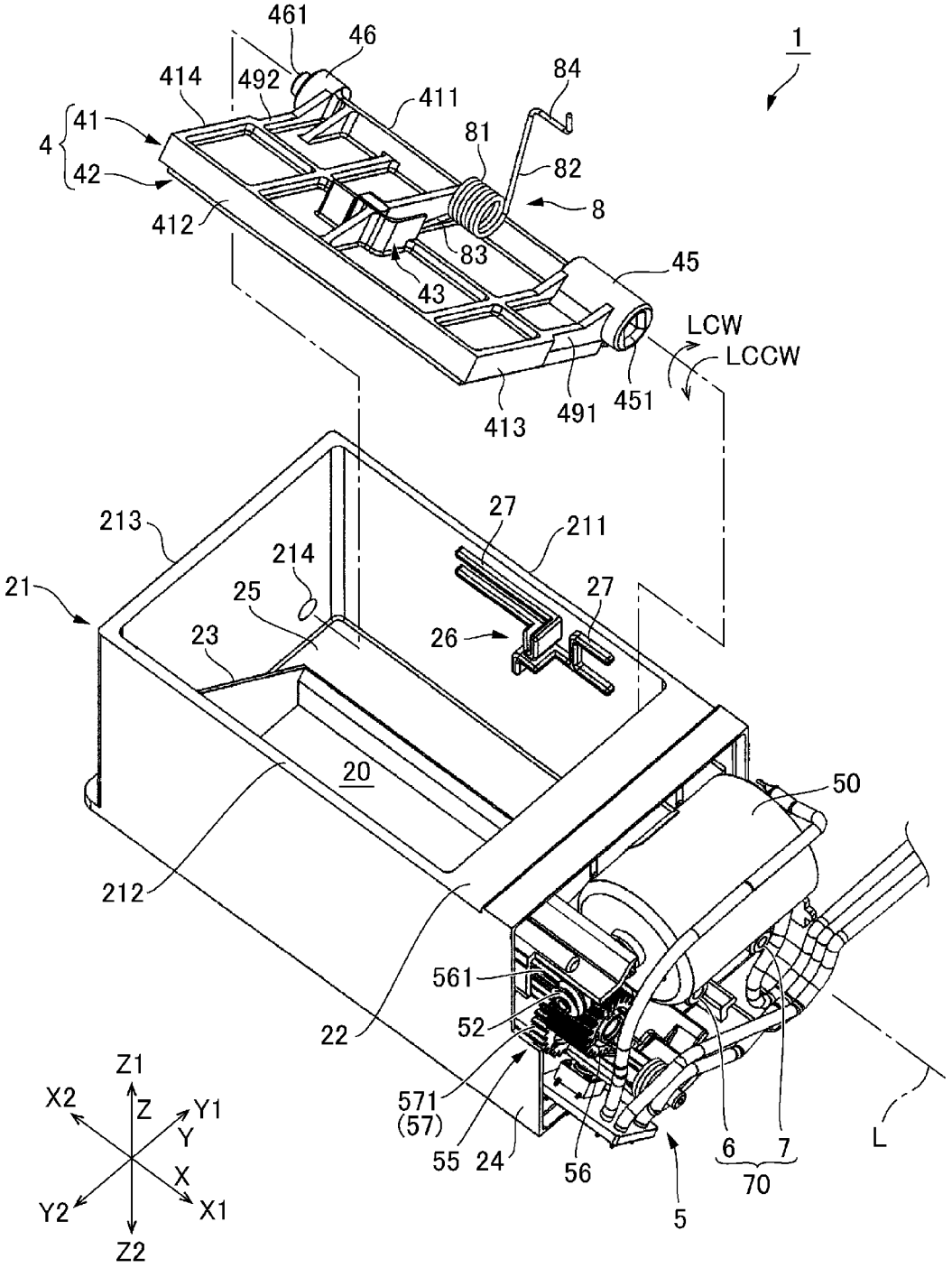
FIG. 2 is an exploded perspective view showing a damper device in which a cover is detached.

FIG. 1 is a perspective view showing a damper device 1 in accordance with at least an embodiment of the present invention and FIG. 2 is an exploded perspective view showing the damper device 1 in which a cover 3 is detached. In the present specification, the reference sign "L" is a turning center axial line of a baffle 4. Further, a direction along the turning center axial line "L" is referred to as an "X" direction, a direction intersecting the turning center axial line "L" (direction in which cold air flows) is referred to as a "Z" direction, and a direction intersecting the "X"

direction and the "Z" direction is referred to as a "Y" direction. Further, one side in the "X" direction is referred to as an "X1", the other side in the "X" direction is referred to as an "X2", one side in the "Y" direction is as a "Y1", the other side in the "Y" direction is as a "Y2", one side in the "Z" direction is as a "Z1", and the other side in the "Z" direction is as a "Z2".

As shown in FIGS. 1 and 2, the damper device 1 is a rectangular parallelepiped shape which is long in the "X" direction as a whole. The damper device 1 includes a frame 2 in which a rectangular opening part 20 is formed, a baffle 4 for opening and closing the opening part 20, and a baffle drive mechanism 5 structured to drive the baffle 4. A cover 3 which covers the baffle drive mechanism 5 is attached to one end side in a longitudinal direction ("X" direction) of the frame 2. The frame 2 and the cover 3 are made of resin. The frame 2 is provided with a tube part 21 having a rectangular cross section which opens to both sides in the "Z" direction. The frame 2 is integrally formed on one side ("X1" direction) in the longitudinal direction of the tube part 21 with a partition wall 22 which partitions an inner side of the tube part 21 from a space in which the baffle drive mechanism 5 is disposed. As shown in FIG. 2, the frame 2 is provided with a side wall 24 which is extended to the cover 3 side (one side "X1" in the "X" direction) along an outer periphery of the partition wall 22. The cover 3 is engaged with the frame 2 by a hook mechanism not shown. In accordance with an embodiment of the present invention, the cover 3 may be fixed to the frame 2 by a fixing member such as a screw instead of using a hook mechanism.

The tube part 21 is structured of a first wall 211 and a second wall 212 which are extended in the "X" direction and a third wall 213 (opposing wall facing the partition wall 22) and the partition wall 22 which are extended in the "Y" direction. As shown in FIG. 2, a frame-shaped seal part 23 which is obliquely inclined with respect to the "Z" direction and the "Y" direction is formed on an inner side of the tube part 21, and the inner side of the seal part 23 is formed to be the opening part 20. The inner side of the tube part 21 is formed with a closing part 25 which closes the inner side of the tube part 21 except the opening part 20.

The baffle 4 is supported by the frame 2 in the inner side of the tube part 21 in a state that the baffle 4 is capable of turning around a turning center axial line "L" which is parallel to the "X" direction. In a state shown in FIG. 1, the baffle 4 is abutted with the seal part 23 and is located at a closing position 4A where the baffle 4 closes the opening part 20. When the baffle drive mechanism 5 drives and turns the baffle 4 to one side "LCW" around the turning center axial line "L" from this state and the baffle 4 is separated from the seal part 23, the baffle 4 is moved to an open position 4B where the baffle 4 opens the opening part 20.

As shown in FIG. 2, the baffle 4 includes a rectangular opening and closing plate 41 whose size is larger than the opening part 20 and a rectangular sheet-shaped elastic member 42 made of foamed polyurethane or the like which is stuck on a face of the opening and closing plate 41 on a side of the opening part 20. The elastic member 42 is abutted with a periphery (seal part 23) of the opening part 20 to close the opening part 20. Cold air is flowed from an opposite side (the other side "Z2" in the "Z" direction) to the side where the baffle 4 is disposed (one side "Z1" in the "Z" direction) with respect to the opening part 20 to the one side "Z1" in the "Z" direction through the opening part 20. Alternatively, cold air may be flowed from the side where the baffle 4 is disposed (one side "Z1" in the "Z" direction) with respect to the opening part 20 to the other side "Z2" in the "Z" direction through the opening part 20.

(Baffle Drive Mechanism)

As shown in FIG. 2, the baffle drive mechanism 5 includes a motor 50, a transmission mechanism 55 structured to transmit rotation of the motor 50 to the baffle 4, and a torsion coil spring 8 as an urging member which urges the baffle 4 to the other side "LCCW" (closing direction) around the turning center axial line "L". As shown in FIG. 1, the torsion coil spring 8 is disposed between the baffle 4 and the frame 2. The torsion coil spring 8 is provided with a coil part 81 and straight line-shaped end parts 82 and 83 which are extended to different directions from both ends of the coil part 81. As shown in FIG. 2, a tip end of one end part 82 of the torsion coil spring 8 is formed with an engaging part 84 which is bent at a substantially right angle. Similarly, a tip end of the other end part 83 is also formed with an engaging part (not shown) which is bent at a substantially right angle.

The first wall 211 of the tube part 21 is formed with a holding part 26 for holding an engaging part 84 formed in the one end part 82 and a frame reinforcing rib 27 which is connected with the holding part 26. The holding part 26 is a rib provided with a groove which is engaged with the engaging part 84. The frame reinforcing rib 27 is extended from the holding part 26 to both sides in the "X" direction. As shown in FIG. 1, the torsion coil spring 8 is attached so that the one end part 82 is extended along the first wall 211 in the "Z" direction and the other end part 83 is extended along a rear face side (opposite side to the elastic member 42) of the opening and closing plate 41 of the baffle 4. The rear face side (opposite side to the elastic member 42) of the opening and closing plate 41 of the baffle 4 is formed with a holding part 43 for holding an engaging part (not shown) provided at a tip end of the other end part 83.

The transmission mechanism 55 includes a worm gear 52 formed on an output shaft 51 of the motor 50, a worm wheel 56 meshed with the worm gear 52, a composite gear 57 provided with a large diameter gear 571 which is meshed with a small diameter gear 561 formed in the worm wheel 56, and a rotation transmission mechanism 10 to which rotation of the composite gear 57 is transmitted through a small diameter gear (not shown) of the composite gear 57. Rotation of the rotation transmission mechanism 10 is transmitted to the baffle 4. Various motors may be used as the motor 50. In this embodiment, a DC motor is used as the motor 50. The motor 50 outputs only rotation in one direction around the motor axial line. In other words, the motor 50 is rotated only in a direction for turning the baffle 4 to one side "LCW" (open direction) around the turning center axial line "L".

The rotation transmission mechanism 10 includes a drive wheel 6 to which rotation of the composite gear 57 is transmitted and a driven wheel 7 with which the baffle 4 is connected. The driven wheel 7 is provided with an output shaft (not shown) for connecting the baffle 4. The output shaft is protruded to the inner side of the tube part 21 through a penetration part which penetrates through the partition wall 22 of the frame 2 and is connected with the baffle 4. When a drive tooth of the drive wheel 6 is meshed with a driven tooth of the driven wheel 7, rotation of the motor 50 is transmitted to the baffle 4, and the baffle 4 is turned to one side "LCW" (open direction) around the turning center axial line "L". Further, when the driven tooth of the driven wheel 7 slides along a cam face of the drive wheel 6, rotation of the motor 50 is not transmitted to the baffle 4, and the baffle 4 is turned to the other side "LCCW" (closing direction) around the turning center axial line "L" by the urging force of the torsion coil spring 8.

(Baffle)

Figure 3A:
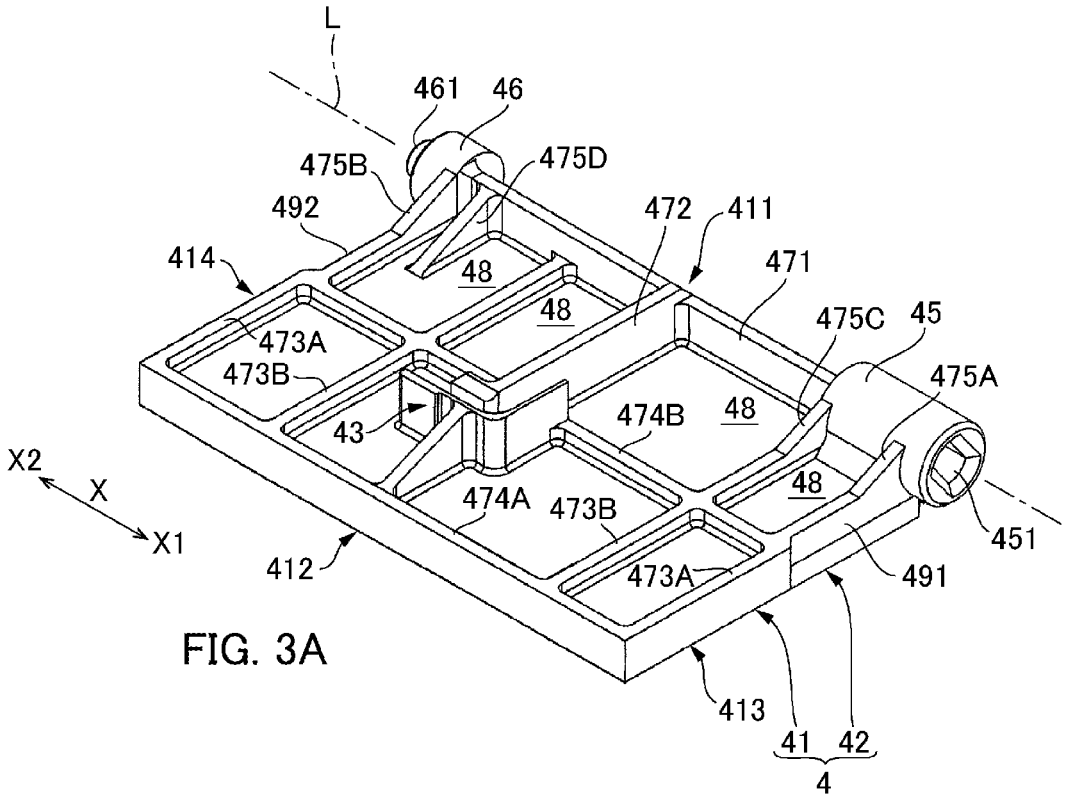
FIGS. 3A and 3B are a perspective view and a plan view showing a baffle.
Figure 3B:
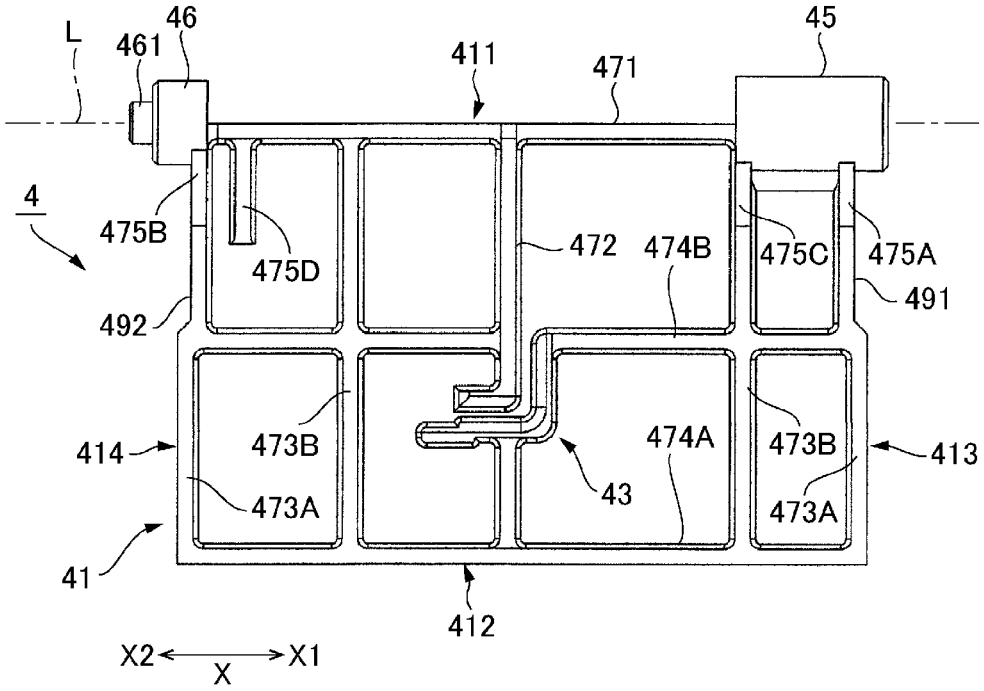

FIG. 3A is a perspective view showing the baffle 4 which is viewed from its rear face side, and FIG. 3B is a plan view showing the baffle 4 which is viewed from the rear face side. The baffle 4 is formed in a rectangular shape which is long in the "X" direction as a whole and is turnably supported with the turning center axial line "L" extended along one of its long sides as a turning center. The baffle 4 is structured so that an elastic member 42 is stuck on a face on the opening part 20 side of the opening and closing plate 41. Hereinafter, in the present specification, an edge on the side where the turning center axial line "L" of the opening and closing plate 41 is provided is referred to as a first edge 411. Further, an edge on an opposite side (edge on the opposite side to the one side) to the turning center axial line "L" is referred to as a second edge 412. Further, in two edges perpendicular (intersecting) to the first edge 411 and the second edge 412, in other words, in two side edges connecting the first edge 411 and the second edge 412, an edge on one side "X1" in the "X" direction is referred to as a first side edge 413 and an edge on the other side "X2" in the "X" direction is referred to as a second side edge 414.

As shown in FIGS. 1 and 2, the turning center axial line "L" of the baffle 4 is disposed at a position close to an end part on the other side "Z2" in the "Z" direction of the tube part 21. The opening part 20 which is opened and closed by the baffle 4 is located on one side "Z1" in the "Z" direction with respect to the turning center axial line "L". Therefore, when the baffle 4 is located at the closing position 4A, the baffle 4 is set in a posture that the first edge 411 is located on the other side "Z2" in the "Z" direction with respect to the second edge 412. Further, when the baffle 4 is located at the open position 4B, the baffle 4 is set in a posture that the baffle 4 is stood up from the first edge 411 toward one side "Z1" in the "Z" direction.

When the damper device 1 in this embodiment is to be attached to a refrigerator as a main body device, the damper device 1 may be used in an arrangement state that the "Z" direction is a vertical direction, one side "Z1" in the "Z" direction is set on an upper side in the vertical direction and the other side "Z2" in the "Z" direction is set on a lower side in the vertical direction. In the arrangement state, when the baffle 4 is located at the closing position 4A shown in FIG. 1, the baffle 4 is set in an inclined posture where the first edge 411 is located on a lower side in the vertical direction with respect to the second edge 412. Further, when the baffle 4 is located at the open position 4B, the baffle 4 is set in a posture that the baffle 4 is stood up from the first edge 411 toward the upper side in the vertical direction so that the second edge 412 is located on an upper side in the vertical direction. In other words, in a case that the baffle 4 is turned between the closing position 4A and the open position 4B, the first edge 411 is always located on a lower side with respect to the second edge 412. Therefore, when dew condensation water is adhered to the opening and closing plate 41, the dew condensation water is flowed toward the first edge 411 which is an edge on a lower side in the vertical direction of the opening and closing plate 41, and the dew condensation water is collected to the first edge 411.

As shown in FIG. 3A, the first edge 411 (edge on the turning center axial line "L" side) of the opening and closing plate 41 is formed with shaft parts 45 and 46 at two positions separated in the "X" direction. The shaft part 45 is formed at a corner part where the first edge 411 and the first side edge 413 of the opening and closing plate 41 are connected with each other. Further, the other shaft part 46 is formed at a corner part where the first edge 411 and the second side edge 414 of the opening and closing plate 41 are connected with each other. As shown in FIG. 3A, a tip end on one side in the "X" direction of the shaft part 45 is formed with a fitting recessed part 451. As described above, the output shaft (not shown) which is provided in the driven wheel 7 of the rotation transmission mechanism 10 is protruded to the inner side of the tube part 21 of the frame 2. A tip end of the output shaft of the rotation transmission mechanism 10 is connected with the shaft part 45 of the baffle 4 through the fitting recessed part 451. As a result, turning of the driven wheel 7 is transmitted to the baffle 4, and the shaft part 45 acts as a turning center of the baffle 4, in other words, acts as a turning center of the opening and closing plate 41. On the other hand, a tip end of the shaft part 46 is formed with a protruded part 461 in a columnar shape. The protruded part 461 is turnably held by a holding hole 214 (see FIG. 2) which is formed in the third wall 213 of the frame 2.

As shown in FIG. 3B, the first side edge 413 and the second side edge 414 of the opening and closing plate 41 are respectively formed with cut-out parts 491 and 492 which are formed by cutting out their portions close to the first edge 411 to inner sides in a width direction ("X" direction) by a predetermined dimension. In other words, the cut-out part 491 is formed in a shape so that a space between the baffle 4 and the inner face of the tube part 21 (inner face of the partition wall 22) facing the first side edge 413 is enlarged in comparison with a space between the baffle 4 and a portion without the cut-out part 491. Further, the cut-out part 492 is formed in a shape so that a space between the baffle 4 and the inner face of the tube part 21 (inner face of the third wall 213 which is an opposing wall facing the partition wall 22) facing the second side edge 414 is enlarged in comparison with a space between the baffle 4 and a portion without the cut-out part 492. Each of the cut-out parts 491 and 492 is formed in a range approximately half of a width in a direction perpendicular to the turning center axial line "L" of the opening and closing plate 41 and is formed at a position close to the first edge 411. In this embodiment, the shaft parts 45 and 46 are formed at both ends of the first edge 411 of the baffle 4. The cut-out part 491 is provided over a width from a substantially center of the first side edge 413 to the shaft part 45. Further, the cut-out part 492 is provided over a width from a substantially center of the second side edge 414 to the shaft part 46.

Figure 4:
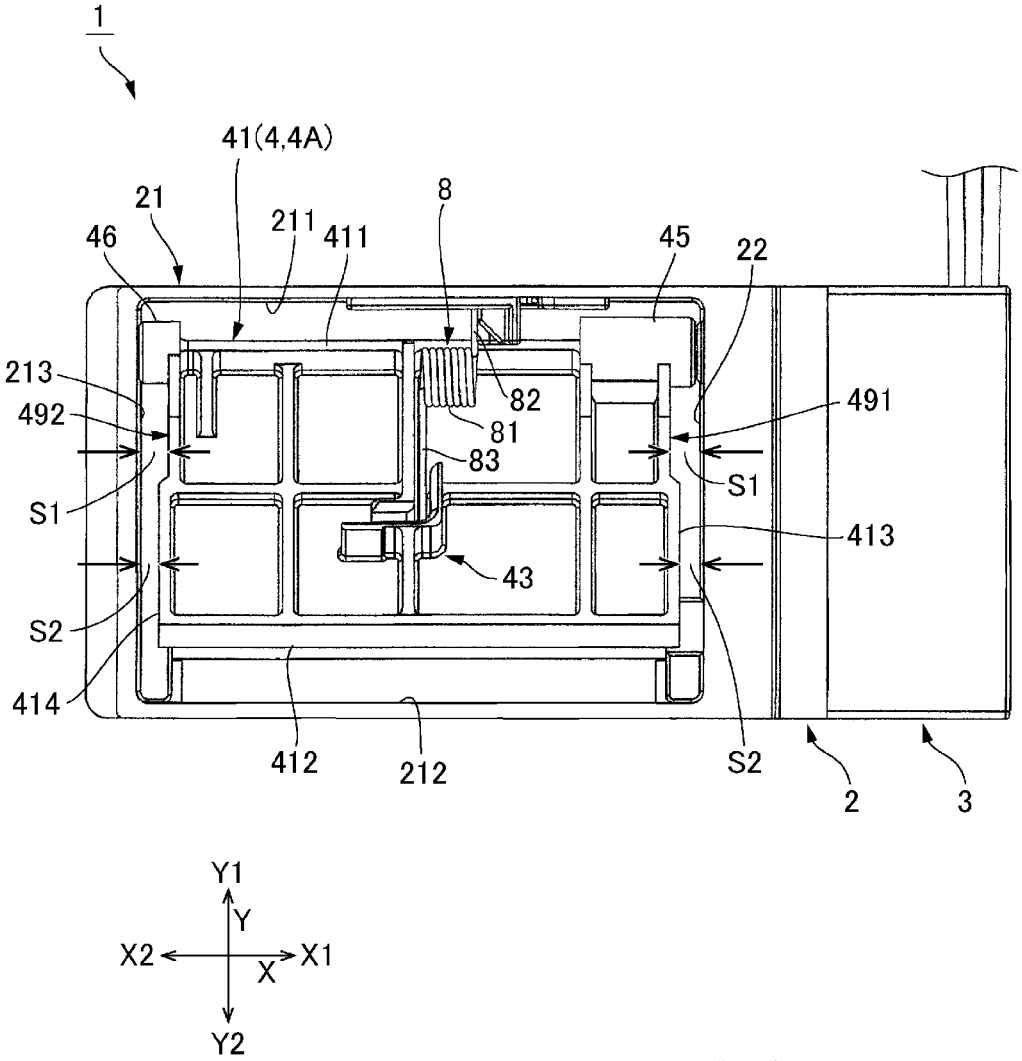
FIG. 4 is a plan view showing a damper device.

FIG. 4 is a plan view showing the damper device 1 and is a plan view showing a state that the baffle 4 is located at the closing position 4A (state in FIG. 1) where the baffle 4 closes the opening part 20 which is viewed from one side "Z1" in the "Z" direction. As shown in FIG. 4, spaces between the baffle 4 and the inner faces of the tube part 21 are enlarged at the positions where the cut-out parts 491 and 492 are formed. In other words, the opening and closing plate 41 is formed with the cut-out parts 491 and 492 so that the spaces "S1" with respect to the inner faces of the tube part 21 on the side close to the shaft parts 45 and 46 are wider than the spaces "S2" to the inner faces of the tube part 21 on the side separated from the shaft parts 45 and 46. The first edge 411 on the side where the shaft parts 45 and 46 are provided is an edge on a side where dew condensation water is flowed down when the dew condensation water is adhered to the opening and closing plate 41. In other words, the baffle 4 is formed in a shape so that a space between the opening and closing plate 41 and the inner face of the tube part 21 is large on the side where dew condensation water is flowed down.

As shown in FIG. 3A, a plurality of ribs is formed in a lattice shape on the rear face side of the opening and closing plate 41 (opposite side to the opening part 20). The opening and closing plate 41 is formed with a dew condensation water holding rib 471 along the first edge 411. Both ends of the dew condensation water holding rib 471 is connected with the shaft part 45 and the shaft part 46. Further, a center reinforcing rib 472 is formed at a center in the longitudinal direction ("X" direction) of the opening and closing plate 41 so as to be extended in a direction perpendicular to the turning center axial line "L" with the same protruded height as the dew condensation water holding rib 471. The center reinforcing rib 472 is formed at its substantially center with the holding part 43 for holding the end part 83 of the torsion coil spring 8. The end part 83 of the torsion coil spring 8 is disposed along the center reinforcing rib 472 and an engaging part (not shown) provided at its tip end is held by the holding part 43.

The opening and closing plate 41 is formed with baffle reinforcing ribs 473A, 473B, 474A and 474B whose protruded heights are lower than those of the dew condensation water holding rib 471 and the center reinforcing rib 472. The baffle reinforcing ribs 473A and 473B are ribs which are parallel to the center reinforcing rib 472, and one baffle reinforcing rib 473A and one baffle reinforcing rib 473B are respectively formed on both sides of the center reinforcing rib 472. The baffle reinforcing rib 473A is formed along the first side edge 413 and the second side edge 414 of the opening and closing plate 41. In this embodiment, the baffle reinforcing ribs 473A are formed in a bent shape at a midway position so as to be along the cut-out parts 491 and 492. Further, each of the two baffle reinforcing ribs 473B is formed between the center reinforcing rib 472 and the baffle reinforcing rib 473A. On the other hand, the baffle reinforcing ribs 474A and 474B are ribs which are parallel to the dew condensation water holding rib 471 and are perpendicular to the baffle reinforcing ribs 473A and 474B and the center reinforcing rib 472. The baffle reinforcing rib 474A is formed along the second edge 412 of the opening and closing plate 41 and the baffle reinforcing rib 474B is formed between the baffle reinforcing rib 474A and the dew condensation water holding rib 471.

In accordance with an embodiment of the present invention, extending directions of the baffle reinforcing ribs 473B and 474B may be different from the above-mentioned embodiment and may be bent at a midway position. For example, the baffle reinforcing rib 473B may be inclined with respect to the direction perpendicular to the turning center axial line "L", or may be provided in an "X"-character shape extended in diagonal directions of the opening and closing plate 41. Further, the baffle reinforcing rib 474B may be inclined with respect to the turning center axial line "L".

The baffle reinforcing ribs 473A formed along the first side edge 413 and the second side edge 414 of the opening and closing plate 41 are connected with the outer peripheral faces of the shaft parts 45 and 46. Connected parts of the two baffle reinforcing ribs 473A with the shaft parts 45 and 46 are formed with inclined parts 475A and 475B whose protruded heights are increased toward the shaft parts 45 and 46. Further, one of the baffle reinforcing ribs 473B is connected with the outer peripheral face of the shaft part 45, and an inclined part 475C whose protruded height is increased toward the shaft part 45 is formed in a connected part of the baffle reinforcing rib 473B with the shaft part 45. In addition, an inclined part 475D which is a dew condensation water holding supplementary rib is formed between the second side edge 414 of the opening and closing plate 41 and the baffle reinforcing rib 473B close to the second side edge 414 so as to be connected with the dew condensation water holding rib 471. The inclined part 475D is a rib which is perpendicular to the turning center axial line "L" and its protruded height is increased toward the dew condensation water holding rib 471. In this embodiment, the inclined faces of the inclined parts 475A through 475D are formed in shapes having the same height and the same inclination.

As described above, both ends in a region along the first edge 411 of the opening and closing plate 41 is formed with a rib structure in which the dew condensation water holding rib 471 and the inclined parts 475A and 475B as the dew condensation water holding supplementary rib are connected with each other in a bent wall shape through the shaft parts 45 and 46. Further, in the region along the first edge 411 of the opening and closing plate 41, a plurality of recessed parts 48 is formed so as to be surrounded in three directions by the dew condensation water holding rib 471, the inclined parts 475A, 475B, 475C and 475D as the dew condensation water holding supplementary rib, the shaft parts 45 and 46, and the center reinforcing rib 472. These recessed parts 48 are surrounded in three directions by the ribs whose protruded heights are higher than those of the baffle reinforcing ribs 473A, 473B, 474A and 474B. Therefore, even when dew condensation water adhered to the opening and closing plate 41 is flowed down to a side of the turning center axial line "L" due to gravity or the like, the dew condensation water is suppressed from being overflowed outside from the opening and closing plate 41.

Figure 5:
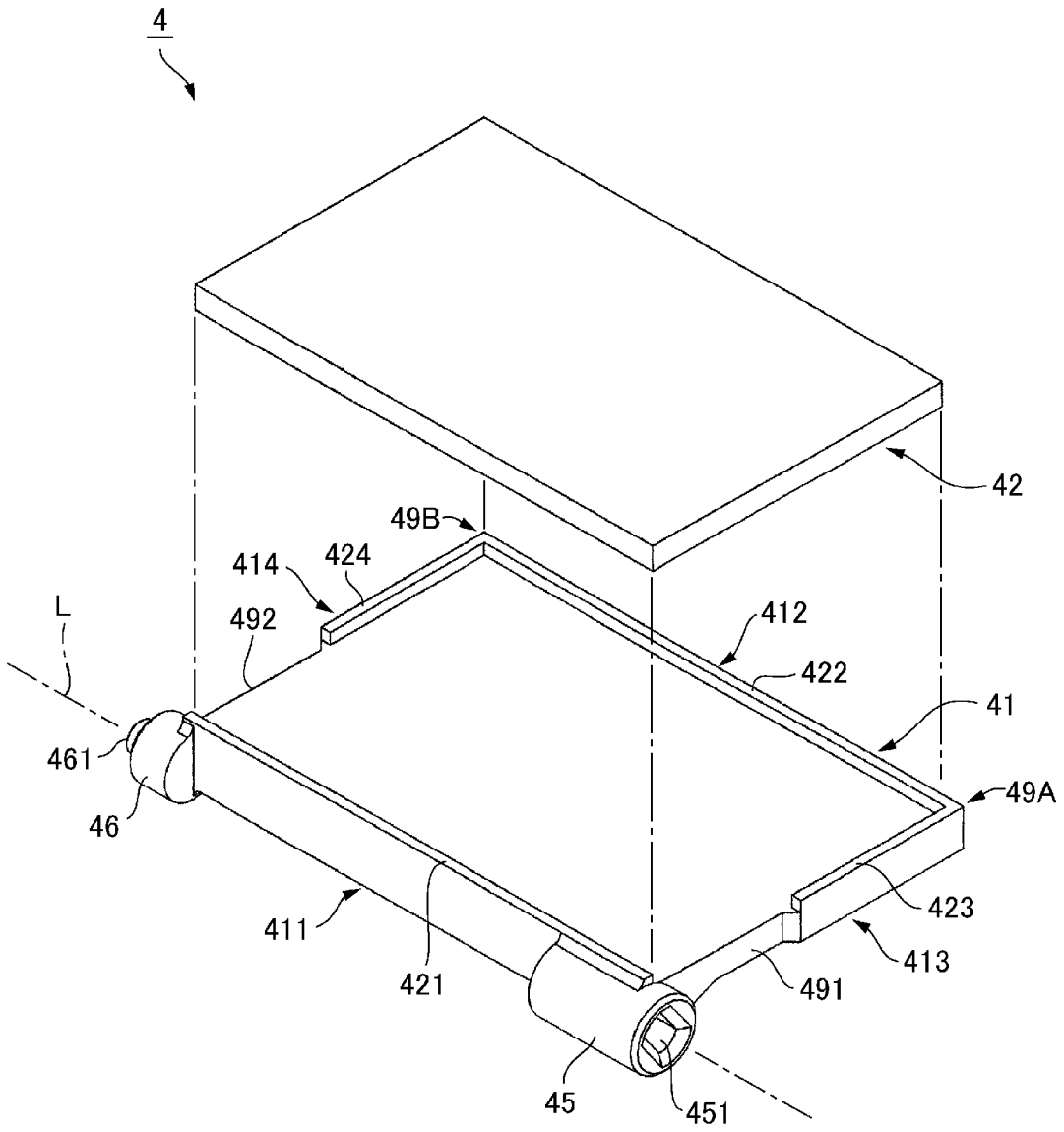
FIG. 5 is an exploded perspective view showing a baffle which is viewed from a side of an opening part.

FIG. 5 is an exploded perspective view showing the baffle 4 which is viewed from a side of the elastic member 42. A face on the opening part 20 side of the opening and closing plate 41 is formed with positioning ribs 421, 422, 423 and 424 surrounding a region where the elastic member 42 is to be attached. The positioning rib 421 is formed along the first edge 411 of the opening and closing plate 41. Further, the positioning rib 422 is formed along the second edge 412 of the opening and closing plate 41. The positioning rib 423 is formed along the first side edge 413 of the opening and closing plate 41, and the positioning rib 424 is formed along the second side edge 414 of the opening and closing plate 41. As described above, the first side edge 413 and the second side edge 414 of the opening and closing plate 41 are formed with the cut-out parts 491 and 492. The positioning ribs 423 and 424 are formed in regions except the regions where the cut-out parts 491 and 492 are formed.

As described above, the opening and closing plate 41 is formed with the first edge 411 and the second edge 412 where the cut-out parts 491 and 492 are not formed, and the first side edge 413 and the second side edge 414 are formed with the cut-out parts 491 and 492. The first edge 411 and the second edge 412 are formed with the positioning ribs 421 and 422 over the entire regions. Therefore, the elastic member 42 is positioned by the positioning ribs 421 and 422 in a direction perpendicular to the turning center axial line "L". Further, in the opening and closing plate 41, the cut-out parts 491 and 492 are formed partly in the first side edge 413 and the second side edge 414 instead of providing the entire regions. In addition, in the first side edge 413 and the second side edge 414, the regions where the cut-out parts 491 and 492 are not formed are formed with positioning ribs 423 and 424. Therefore, the elastic member 42 is positioned by the positioning ribs 423 and 424 in a direction along the turning center axial line "L". Further, in this embodiment, the positioning ribs 422 and 423 are connected with each other in a perpendicular shape at a corner part 49A where the second edge 412 separated from the turning center axial line "L" and the first side edge 413 are intersected each other. Similarly, the positioning ribs 422 and 424 are connected with each other in a perpendicular shape at a corner part 49B where the second edge 412 and the second side edge 414 are intersected each other. Therefore, the elastic member 42 is positioned on the opening and closing plate 41 by the two corner parts 49A and 49B.

Principal Effects in this Embodiment

As described above, in the damper device 1 in this embodiment, an edge except the first edge 411 on the turning center axial line "L" side of the baffle 4 is formed with at least one cut-out part for enlarging a space between the tube part 21 and the edge. For example, the cut-out parts 491 and 492 are formed in the side edges 413 and 414. Therefore, in the portions where the cut-out parts 491 and 492 are formed, a space between the baffle 4 and the inner face of the tube part 21 is large and thus dew condensation water is hard to be held in a state that the dew condensation water stays between the baffle 4 and the tube part 21. Accordingly, a defective operation of the baffle 4 due to freezing of the dew condensation water can be suppressed. Further, the edges except the first edge 411 (second edge 412, first side edge 413 and second side edge 414) are portions which are largely moved when the baffle 4 is opened and closed. Further, the first edge 411 is provided with the shaft parts 45 and 46 which turnably support the baffle 4 and the like and thus, even when a cut-out part is not provided in the first edge 411, a space between the first edge 411 and the inner face of the tube part 21 is larger than other portions. Therefore, when the edges except the first edge 411 are provided with the cut-out parts 491 and 492 for preventing freezing, a defective operation of the baffle 4 can be suppressed effectively.

In this embodiment, the positioning ribs 421 and 422 for positioning the elastic member 42 are formed over the entire regions of the first edge 411 and the second edge 412 where the cut-out parts 491 and 492 are not formed. In addition, also in the first side edge 413 and the second side edge 414 in which the cut-out parts 491 and 492 are formed, the positioning ribs 423 and 424 are formed in the regions where the cut-out parts 491 and 492 are not provided. Therefore, while a defective operation due to freezing is suppressed by providing the cut-out parts 491 and 492, the elastic member 42 can be positioned and thus assembling of the baffle 4 is satisfactorily performed. In accordance with an embodiment of the present invention, a part of the positioning ribs 421, 422, 423 and 424 in this embodiment may be omitted. However, in order to perform positioning of the elastic member 42, it is desirable that at least a part of the edges in which the cut-out parts 491 and 492 are not formed is provided with a positioning rib. Further, like the embodiment described above, it is desirable that positioning ribs are connected with each other at the corner parts 49A and 49B of the opening and closing plate 41.

In this embodiment, when the baffle 4 is located at the closing position 4A, the first edge 411 of the opening and closing plate 41 is disposed in a state that the first edge 411 is located on a lower side in the vertical direction with respect to the second edge 412 on an opposite side to the first edge 411. Further, the cut-out parts 491 and 492 are formed in a region close to the first edge 411. Therefore, a space between the baffle 4 and the inner face of the tube part 21 is enlarged in a region to which dew condensation water adhered to the baffle 4 is collected and thus freezing of the dew condensation water which stays between the baffle 4 and the inner faces of the tube part 21 is hard to be occurred. Accordingly, a defective operation of the baffle 4 can be suppressed. Especially, in this embodiment, the cut-out parts 491 and 492 are provided so as to reach to the shaft parts 45 and 46 formed at both ends of the first edge 411 of the baffle 4 and thus, the cut-out parts 491 and 492 are provided to the peripheries of the shaft parts 45 and 46 where dew condensation water is most easily collected. Therefore, freezing of dew condensation water which stays between the baffle 4 and the inner face of the tube part 21 is effectively suppressed.

In this embodiment, the dew condensation water holding rib 471 is formed along the first edge 411 on the rear face of the opening and closing plate 41. Further, the dew condensation water holding rib 471 is connected with dew condensation water holding supplementary ribs (inclined part 475) which are formed along the side edges 413 and 414 of the opening and closing plate 41. Therefore, dew condensation water which flows to the edge on a side of the turning center axial line "L" of the baffle 4 (in other words, a lower side edge in the vertical direction) can be held by the recessed part 48 surrounded by the dew condensation water holding rib 471 and the inclined parts 475. Accordingly, dew condensation water is suppressed from flowing out to the bottom part of the frame 2. Further, the protruded heights of the dew condensation water holding rib 471 and the inclined parts 475 are higher than those of the baffle reinforcing ribs 473 and 474. Therefore, a lot of dew condensation water can be held, dew condensation water is suppressed from flowing out to the bottom part of the frame 2, freezing of water between the frame and the baffle can be avoided, and the baffle can be acted smoothly.

In this embodiment, the torsion coil spring 8 is disposed between the first wall 211 of the tube part 21 and the baffle 4, and the first wall 211 is provided with the holding part 26 which holds one end part 82 of the torsion coil spring 8 and, in addition, the frame reinforcing rib 27 is formed so as to be connected with the holding part 26. Therefore, deformation of the tube part 21 due to a force applied by the torsion coil spring 8 is suppressed. In this embodiment, the torsion coil spring 8 is used as an urging member, but an urging member such as a flat spring may be used. Further, in this embodiment, the baffle 4 is urged to the closing direction from a side of the first wall 211 (to the other side "LCCW" around the turning center axial line "L"). However, an urging member may be disposed so as to urge the baffle 4 to the closing direction from the opening part 20 side. For example, it may be structured that an urging member such as a compression spring is disposed in the opening part 20 to urge the baffle 4 to the opening part 20 side.

Modified Embodiments

In the embodiment described above, two cut-out parts 491, 492 are provided in the opening and closing plate 41. However, the cut-out part may be provided at one position or three or more positions. Further, its position and width may be modified appropriately. However, it is desirable that the cut-out part is provided in a region located on a lower side in the vertical direction in a state that the damper device 1 is disposed like the embodiment described above. For example, it is desirable that the cut-out part is provided in a region close to the turning center axial line "L". Further, in a case that the damper device 1 is set in another disposing state, it is desirable that the cut-out part is provided in a region to which dew condensation water is flowed, for example, that the cut-out part is provided in an edge or a side edge located on a lower side in the vertical direction.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A damper device comprising:

a frame comprising a wall part and an opening formed on an inner side of the wall part;

a baffle which is disposed on the inner side of the wall part and is supported by the frame in a state that the baffle structured to be turned with a first edge of edges as a turning center; and a baffle drive mechanism structured to turn the baffle between a closing position where the opening is closed and an open position where the opening is opened;

wherein the baffle is formed with a single cut-out on at least one edge of the edges, the single cut-out not being formed on the first edge, the baffle comprises a shaft part formed on the first edge such that a space defined closer to the shaft part and between an inner face of the wall part facing the single cut-out and the single cut-out is larger than a space defined farther from the shaft part and between the inner face of the wall part and a portion of the at least one edge which is not formed with the single cut-out, the single cut-out of the at least one edge is formed near the shaft part, and the portion of the at least one edge which is not formed with the single cut-out extends from the single cut-out to an edge of the edges which is opposite to the first edge.

2. The damper device according to claim 1, wherein the baffle comprises an opening and closing plate and an elastic member attached to a face of the opening and closing plate facing the opening, the opening and closing plate comprises an edge in which the single cut-out is not formed, and the face of the opening and closing plate facing the opening comprises a positioning rib structured to position the elastic member in at least a part of the edges in which the single cut-out is not formed.

3. The damper device according to claim 2, wherein the positioning rib is provided in at least one of the first edge and a second edge of the opening and closing plate opposite to the first edge in a vertical direction.

4. The damper device according to claim 1, wherein the baffle is structured so that the first edge is located on a lower side of the damper device in a vertical direction with respect to a second edge opposite to the first edge along the vertical direction in the closing position.

5. The damper device according to claim 4, wherein the single cut-out is formed in a side edge substantially perpendicular to the first edge at a position closer to the first edge than to the second edge.

6. The damper device according to claim 5, wherein the side edge is formed with the single cut-out having a width so as to reach to the shaft part.

7. The damper device according to claim 6, wherein the baffle comprises a dew condensation water holding rib which is formed on an opposite side face to the opening, and the dew condensation water holding rib is formed along the first edge.

8. The damper device according to claim 7, wherein the dew condensation water holding rib is connected with a rib formed along the side edge.

9. The damper device according to claim 7, wherein the baffle comprises a baffle reinforcing rib which is formed on the opposite side face to the opening, and a protruded height of the dew condensation water holding rib is higher than a protruded height of the baffle reinforcing rib.

10. The damper device according to claim 5, wherein the wall part comprises:

a partition wall which partitions the inner side of the wall part from a space in which the baffle drive mechanism is disposed; and an opposing wall which faces the partition wall, two side edges are provided at two positions on both sides of the first edge, respectively, and spaces between the two side edges and the partition wall and the opposing wall are enlarged by the single cut-out.

11. The damper device according to claim 4, wherein the baffle comprises:

an opening and closing plate which is formed in a rectangular shape; and an elastic member formed in a rectangular shape which is attached to the face of the opening and closing plate facing the opening, the opening and closing plate comprises the first edge, a second edge on an opposite side to the first edge, and two side edges connecting the first edge with the second edge, the single cut-out is formed in each of the two side edges, and in a state that the frame is attached to a main body device, when the baffle is moved to the closing position and the open position, the first edge is always located on a lower side of the damper device with respect to the second edge.

12. The damper device according to claim 11, wherein the opening and closing plate comprises a shaft part configured as a turning center of the opening and closing plate, the shaft part being formed at a corner part where the first edge and a first side edge of the two side edges are connected, and the first side edge is formed with the single cut-out having a width so as to reach to the shaft part.

13. The damper device according to claim 12, wherein the opening and closing plate comprises a dew condensation water holding rib which is formed on an opposite side face to the opening, and the dew condensation water holding rib is formed along the first edge.

14. The damper device according to claim 13, wherein the dew condensation water holding rib is connected with a dew condensation water holding supplementary rib which is formed along each of the two side edges.

15. The damper device according to claim 13, wherein the opening and closing plate comprises a baffle reinforcing rib which is formed on the opposite side face to the opening, and a protruded height of the dew condensation water holding rib is higher than a protruded height of the baffle reinforcing rib.

16. The damper device according to claim 11, wherein the wall part comprises:

a partition wall which partitions the inner side of the wall part from a space in which the baffle drive mechanism is disposed; and an opposing wall which faces the partition wall, the single cut-out is provided in each of the two side edges of the opening and closing plate, and spaces between the two side edges and the partition wall and the opposing wall are enlarged by the single cut-out.

17. The damper device according to claim 1, wherein the baffle drive mechanism comprises an urging member which is disposed between the frame and the baffle, and the frame is formed with a holding part which holds an end part of the urging member and a frame reinforcing rib which is connected with the holding part.

* * * * *